US006860367B1

(12) United States Patent
Ericson

(10) Patent No.: US 6,860,367 B1
(45) Date of Patent: Mar. 1, 2005

(54) ELEVATOR SYSTEM HAVING DRIVE MOTOR LOCATED BELOW THE ELEVATOR CAR

(75) Inventor: Richard J. Ericson, Southington, CT (US)

(73) Assignee: Otis Elevator Company, Farmington, CT (US)

( * ) Notice: Subject to any disclaimer, the term of this patent is extended or adjusted under 35 U.S.C. 154(b) by 633 days.

(21) Appl. No.: 09/162,821

(22) Filed: Sep. 29, 1998

(51) Int. Cl.[7] ..... B66B 11/08; B66B 11/04

(52) U.S. Cl. ..... 187/265; 187/251; 187/252; 187/254; 187/266

(58) Field of Search ..... 187/251, 252, 187/254, 264–6

(56) References Cited

U.S. PATENT DOCUMENTS

| | | | | |
|---|---|---|---|---|
| 12,640 | A | * | 4/1855 | Murtaugh |
| 30,831 | A | * | 12/1860 | Murtaugh |
| 657,380 | A | * | 9/1900 | Baldwin |

(List continued on next page.)

FOREIGN PATENT DOCUMENTS

| | | | | |
|---|---|---|---|---|
| AU | 1 032 496 | | 6/1958 | |
| DE | 2333120 | | 1/1975 | |
| DE | 39 222 798 | | 9/1990 | |
| DE | 296 15 921 | U1 | 4/1997 | |
| DE | 19632850 | | 2/1998 | |
| EP | 0565516 | | 10/1993 | |
| EP | 0 606 875 | A1 | 1/1994 | |
| EP | 0 779 233 | A2 | 6/1994 | |
| EP | 0 784 030 | A2 | 6/1994 | |
| EP | 0 669 276 | | 1/1995 | |
| EP | 0 688 735 | A2 | 6/1995 | |
| EP | 0 710 618 | A2 | 10/1995 | |
| EP | 0688735 | | 12/1995 | |
| EP | 0 749 930 | A2 | 6/1996 | |
| EP | 0 749 931 | A2 | 6/1996 | |
| EP | 0749930 | | 12/1996 | |
| FR | 2 640 604 | | 12/1988 | |
| FR | 2640604 | | 6/1990 | |
| GB | 1 401 197 | | 6/1972 | |
| GB | 2 138 397 | B | 11/1985 | |
| GB | 2 2-1 657 | B | 8/1990 | |
| JP | 74020811 | * | 5/1974 | |
| JP | 59-40276 | | 3/1984 | |
| JP | 64-21180 | | 2/1989 | |
| JP | 1-242386 | | 9/1989 | |
| JP | 2-225280 | | 9/1990 | |
| JP | 3-36184 | | 2/1991 | |
| JP | 5-78066 | | 3/1993 | |
| JP | 6-239554 | | 8/1994 | |
| SU | 505764 | * | 4/1976 | |
| SU | 001227585 | * | 4/1986 | ..... 187/265 |
| WO | PCT/FI97/00824 | | 9/1995 | |
| WO | WO 96/09978 | | 4/1996 | |
| WO | PCT/FI95/00530 | | 12/1997 | |
| WO | PCT/FI97/00823 | | 12/1997 | |
| WO | WO 98/29326 | * | 7/1998 | |
| WO | WO9829327 | | 7/1998 | |

OTHER PUBLICATIONS

"Elevators", by F.A. Annett, 3rd Edition (1960).

"Hannover Fair: Another new idea from ContiTech—Lifting belts for elevators", ContiTech initiativ 1/98 (Hannover Fair '98).

"Elevator Mechanical Design, Principles and Concepts", by Lubomir Janovsky, Ellis Horwood Limited (1987).

*Primary Examiner*—Steven B. McAllister

(57) ABSTRACT

An elevator system includes an elevator hoistway defined in a surrounding structure, such as a building. An elevator car and counterweight are located in the hoistway. A drive motor and associated drive sheave are disposed at a bottom portion of the hoistway. The drive motor is coupled to the elevator car and the counterweight via at least one flat rope for moving the elevator car upwardly and downwardly along the hoistway.

3 Claims, 2 Drawing Sheets

U.S. PATENT DOCUMENTS

| | | | | | |
|---|---|---|---|---|---|
| 701,328 | A | * | 6/1902 | Gill | 187/265 X |
| 810,941 | A | | 1/1906 | De Buren | |
| 975,790 | A | * | 11/1910 | Pearson | 187/254 |
| 988,016 | A | | 3/1911 | Neenan | |
| 1,011,423 | A | * | 12/1911 | Gale | 187/254 X |
| 1,035,230 | A | * | 8/1912 | Pearson | 187/254 |
| 1,071,309 | A | | 8/1913 | Goggin | |
| 1,126,260 | A | | 1/1915 | Neenan et al. | |
| 1,132,761 | A | * | 3/1915 | Boening | |
| 1,132,769 | A | * | 3/1915 | Gale | 187/264 |
| 1,566,385 | A | * | 12/1925 | Dunn | |
| 1,944,772 | A | * | 1/1934 | White | 187/265 |
| 1,997,060 | A | | 4/1935 | Hirshfeld | 187/3 |
| 3,101,130 | A | | 8/1963 | Bianca | |
| 3,174,585 | A | | 3/1965 | Tofanelli | 187/22 |
| 3,810,529 | A | * | 5/1974 | Tosato et al. | |
| 4,570,753 | A | | 2/1986 | Ohta et al. | 187/1 |
| 4,949,815 | A | | 8/1990 | Pavoz | 187/20 |
| 5,398,781 | A | | 3/1995 | Biewald et al. | 187/264 |
| 5,429,211 | A | | 7/1995 | Aulanko et al. | 187/254 |
| 5,435,417 | A | | 7/1995 | Hakala | 187/404 |
| 5,469,937 | A | | 11/1995 | Hakala et al. | 187/266 |
| 5,490,577 | A | * | 2/1996 | Yoo | 187/252 |
| 5,490,578 | A | | 2/1996 | Aulanko et al. | 187/254 |
| 5,526,901 | A | * | 6/1996 | Salmon | 187/254 X |
| 5,566,786 | A | | 10/1996 | De Angelis et al. | 187/266 |

* cited by examiner

ELEVATOR SYSTEM HAVING DRIVE MOTOR LOCATED BELOW THE ELEVATOR CAR

FIELD OF THE INVENTION

The present invention relates generally to an elevator system, and more particularly to an elevator system including a drive motor located in the hoistway below the elevator car.

BACKGROUND OF THE INVENTION

Considerable expense is involved in the construction of a machine room for an elevator. The expense includes the cost of constructing the machine room, the structure required to support the weight of the machine room and elevator equipment, and the cost of shading adjacent properties from sunlight (e.g., sunshine laws in Japan and elsewhere).

Elevator systems have been developed to avoid the expense of a machine room. These elevator systems are difficult to install and maintain because hoistway access can be difficult or dangerous especially to maintenance people while working in the hoistway on machinery that controls elevator motion if the machinery, such as the drive motor, is located in a space between the elevator car and a sidewall of the hoistway. Furthermore, elevator systems typically require additional hoistway space to accommodate machinery disposed between the car and sidewall of the hoistway.

It is an object of the present invention to provide an elevator system without a machine room which avoids the above-mentioned drawbacks associated with prior elevator systems.

SUMMARY OF THE INVENTION

An elevator system includes an elevator hoistway defined in a surrounding structure, such as a building. An elevator car and counterweight are located in the hoistway. A drive motor and associated drive sheave are located at a bottom portion of the hoistway such as the hoistway pit which is easily accessible by maintenance people. The drive motor is coupled to the elevator car and the counterweight via at least one flat rope for moving the elevator upwardly and downwardly along the hoistway.

An advantage of the present invention is that the elevator system significantly reduces the space and construction costs compared with an elevator system having a machine room.

A second advantage of the present invention is that the hoistway dimensions can be kept to a minimum because the drive motor does not encroach into the hoistway space between the elevator car and a sidewall of the hoistway.

A third advantage of the present invention is simplified and safe access to the drive motor and associated equipment from the elevator pit.

A fourth advantage of the present invention is that flat rope technology reduces the size of the drive motor and sheaves, and thereby reduces the pit space required for accommodating the motor and sheaves.

DETAILED DESCRIPTION OF THE PREFERRED EMBODIMENTS

Figure 1:
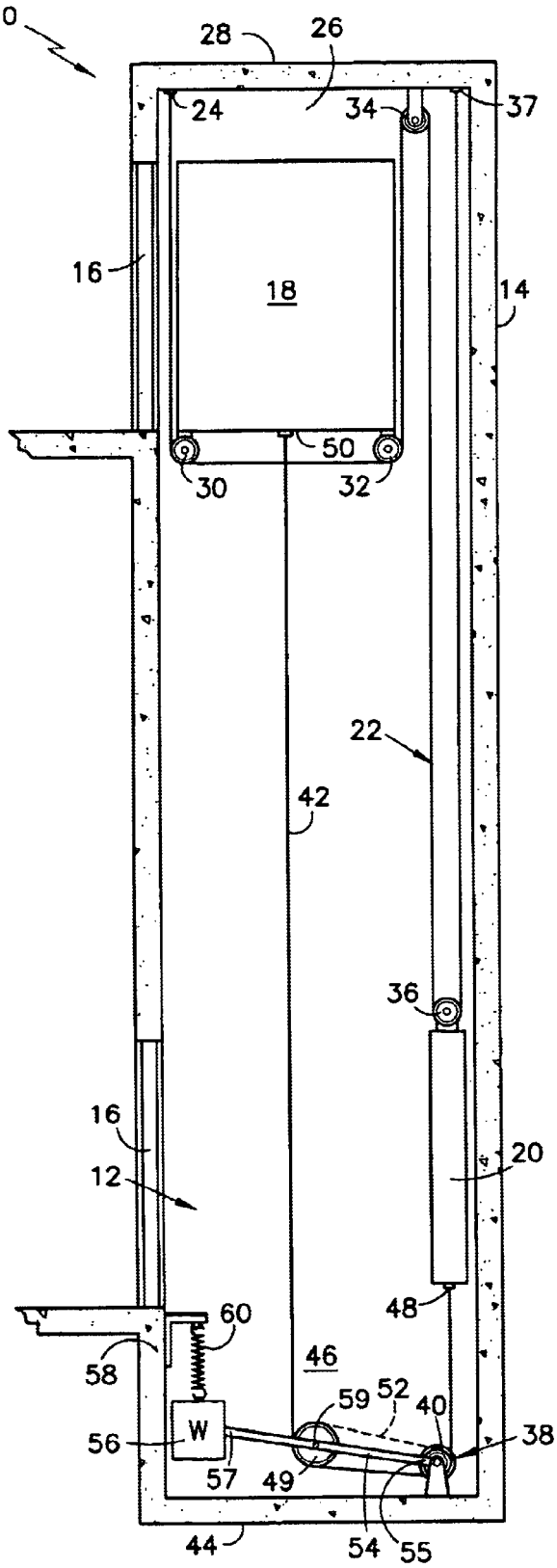
FIG. 1 is a schematic, side elevational view of an elevator system embodying the present invention having the drive motor accessibly located in the hoistway pit below the elevator car.

Referring to FIG. 1, an elevator system embodying the present invention is generally designated by the reference number 10. The elevator system 10 includes a hoistway 12 defined by a surrounding structure 14, such as a building. The hoistway 12 includes door openings at each level along the hoistway for accepting hoistway doors 16, 16. An elevator car 18 is provided in the hoistway 12 for upward and downward movement along the hoistway via conventional elevator guide rails (not shown). A counterweight 20 movably coupled to conventional counterweight guide rails (not shown) is located at a side of the hoistway 12 in a space extending along the length of the hoistway between the elevator car 18 and the sidewall 14 of the hoistway for balancing the elevator car during its upward and downward movement along the hoistway.

The elevator system 10 includes at least one flat, suspension rope or belt 22 for supporting the weight of the elevator car 18 and the counterweight 20. The suspension rope 22 may be made of steel, non-metallic fiber or any other suitably strong material to support the elevator car 18 and the counterweight 20 during movement and acceleration of the elevator car and the counterweight along the hoistway 12.

The employment of flat ropes or belts permits smaller drive motors and sheaves to drive and suspend elevator car and counterweight loads relative to drive motors and sheaves using conventional round ropes. The diameter of drive sheaves used in elevators with conventional round ropes is limited to 40 times the diameter of the ropes, or larger, due to fatigue of the ropes as they repeatedly conform to the diameter of the sheave and straighten out. Flat ropes or belts have an aspect ratio greater than one, where aspect ratio is defined as the ratio of rope or belt width w to thickness t (Aspect Ratio=w/t). Therefore, flat ropes or belts are inherently thin relative to conventional round ropes. Being thin, there is less bending stress in the fibers when the belt is wrapped around a given diameter sheave. This allows the use of smaller diameter traction sheaves. Torque is proportional to the diameter of the traction sheave. Therefore, the use of a smaller diameter traction sheave reduces motor torque. Motor size (rotor volume) is roughly proportional to torque; therefore, although the mechanical output power remains the same regardless of sheave size, flat ropes or belts allow the use of a smaller drive motor operating at a higher speed relative to systems using conventional round ropes. Consequently, smaller conventional and flat drive motors may be accommodated in the hoistway pit which significantly reduces the size and construction cost of the hoistway pit.

In summary, reducing the machine size (i.e., drive motor and sheaves) has a number of advantages. First, the smaller machine reduces the hoistway pit space requirement when the machine is located below the elevator car. Second, a small machine utilizes less material, and will be less costly to produce relative to a larger machine. Third, the light weight of a small machine reduces the time for handling the machine and the need for equipment to lift the machine into place so as to significantly reduce installation cost. Fourth, low torque and high speed allow the elimination of gears, which are costly. Further, gears can cause vibrations and noise, and require maintenance of lubrication. However, geared machines may be employed if desired.

Flat ropes or belts also distribute the elevator and counterweight loads over a greater surface area on the sheaves relative to round ropes for reduced specific pressure on the ropes, thus increasing its operating life. Furthermore, the flat ropes or belts may be made from a high traction material such as urethane or rubber jacket with fiber or steel reinforcement.

The suspension rope 22 is attached at a first end to a first bracket 24 which is fixedly coupled within an upper portion of the hoistway 12, such as to a sidewall 26 or ceiling 28 of the hoistway. The suspension rope 22 extends downwardly from its first end, loops generally 90° about a first elevator sheave 30 coupled underneath and at one side of the elevator car 18, extends generally horizontally to a second elevator sheave 32 coupled underneath and at an opposite side of the elevator car, loops generally 90° about the second elevator sheave 32, extends upwardly and loops generally 180° about a first deflector sheave 34 fixedly coupled within an upper portion of the hoistway, such as to the sidewall 26 or the ceiling 28 of the hoistway 12, extends downwardly and loops generally 180° about a counterweight sheave 36 coupled to a top portion of the counterweight 20, and extends upwardly and is coupled at a second end within an upper portion of the hoistway, such as to the sidewall or ceiling of the hoistway via a second bracket 37.

The elevator system 10 includes a drive motor 38 having a drive sheave 40 for moving the elevator car 18 and the counterweight 20 upwardly and downwardly along the hoistway 12 via at least one flat, drive rope or belt 42. The drive rope 42 may be made of steel, non-metallic fiber or any other suitably strong material to support the weight of imbalance between the elevator car 18 and the counterweight 20. The drive motor 38 is coupled to and supported by a sidewall or floor 44 of the hoistway 12 within a hoistway pit 46. As shown in FIG. 1, for example, the drive rope 42 is coupled at a first end to a lower portion 48 of the counterweight 20, extends downwardly and loops generally 90° about the drive sheave 40, extends generally horizontally and loops generally 90° about a second deflector sheave 49, and extends upwardly and is coupled at a second end to an underside 50 of the elevator car 18. Because the drive motor 38 is located below the elevator car 18 in the hoistway pit 46, the elevator system 10 avoids the additional expense and space associated with constructing and maintaining a machine room.

The drive rope 42 may also be employed in a "double wrap traction" configuration. In such a configuration, the drive rope 42 is coupled at its first end to the lower portion 48 of the counterweight 20, extends downwardly and loops generally 90° about the drive sheave 40, extends generally horizontally and loops generally 180° about the second deflector sheave 49, extends generally horizontally as shown by the dashed line 52 and loops generally 180° about the drive sheave 40, extends generally horizontally and loops generally 90° about the second deflector sheave 49, and extends upwardly and is coupled at its second end to the underside 50 of the elevator car 18. As shown in FIG. 1, the suspension rope 22 and the drive rope 42 are separate and independent from one another.

As shown in FIG. 1, an elongated rigid connector 54 is pivotally coupled at a first end 55 to a rotational axis of the drive sheave 40 and at a second end 57 to a weight 56 which is suspended from a lower portion of the hoistway 12, such as a sidewall 58 of the hoistway via a tension spring 60. The rigid connector 54 is also coupled at 59 between its first and second ends 55, 57 to a rotational axis of the second deflector sheave 49. The weight 56 imparts a downward force to the second end 57 of the rigid connector 54 which pivots the rigid connector downwardly about its first end 55, and in turn moves the second deflector sheave 49 downwardly in order to provide tension in the drive rope 42 between the second deflector sheave 49 and the elevator car 18. Thus, the rigid connector 54, the weight 56, and the tension spring 60 cooperate as a tension applying mechanism for maintaining the drive rope 42 in a taut condition.

The elevator system 10 tolerates large imbalances in the tension of the drive rope 42 between the elevator side and the counterweight side of the elevator system. For example, if the drive rope 42 is a non-metallic fiber belt, such as urethane, having a relatively high coefficient of friction $\mu$=0.5 relative to steel rope, the traction available to drive the elevator car 18 with double wrap traction is $e^{\mu\theta}=e^{.5(2\Pi)}=2.71828^{529}=23.14$. This traction relation value of "23.14" means that $t_1/t_2$ must be greater than 23.14 before the drive rope 42 begins to slip on the drive sheave 40 and the second deflector sheave 49, where $t_1$ is the tension in the portion of the drive rope 42 between the second deflector sheave 49 and the elevator car 18, and $t_2$ is the tension in the drive rope between the drive sheave 40 and the counterweight 20. A considerable imbalance in tension in the drive rope 42 can thus be tolerated relative to an elevator system employing conventional steel rope and cast iron sheaves having a traction relation of only about 5.

In operation, the drive motor 38 is signaled by a controller (not shown) to rotate the drive sheave 40 counterclockwise in order to move the elevator car 18 downwardly along the hoistway 12. The rotating drive sheave 40 causes the second deflector sheave 49 also to rotate counterclockwise which pulls downwardly a portion of the drive rope 42 between the elevator car 18 and the second deflector sheave 49. The downwardly moving drive rope 42, in turn, pulls downwardly the elevator car 18 attached to the drive rope at its underside 50. The downwardly moving elevator car 18 causes the elevator sheaves 30, 32 to roll along the suspension rope 22 along its length and away from the first end of the suspension rope at the first bracket 24. The downwardly moving elevator 18 pulls downwardly on a portion of the suspension rope 22 between the second elevator sheave 32 and the first deflector sheave 34. This downward pull causes the first deflector sheave 34 to rotate counterclockwise which pulls upwardly on a portion of the suspension rope 22 between the first deflector sheave 34 and the counterweight 20 to thereby move the counterweight upwardly.

The drive motor 38 is also signaled by a controller (not shown) to rotate the drive sheave 40 clockwise in order to move the elevator car 18 upwardly along the hoistway 12. The rotating drive sheave 40 pulls downwardly on a portion of the drive rope 42 between the drive sheave 40 and the counterweight 20. The downwardly moving drive rope 42, in turn, downwardly pulls the counterweight 20 attached to the drive rope at its lower portion 48. The downwardly moving counterweight 20 causes the counterweight sheave 36 to rotate counterclockwise and to pull downwardly on a portion of the suspension rope 22 between the counterweight 20 and the first deflector sheave 34. The downwardly moving portion of the suspension rope 22 causes the first deflector sheave 34 to rotate clockwise, which in turn, causes the elevator sheaves 30, 32 to roll along the suspension rope along its length toward the first end of the suspension rope at the first bracket 24. The rolling elevator sheaves 30, 32 cause the elevator car 18 to move upwardly along the hoistway 12.

A problem may arise if the elevator car 18 is not operating near full capacity. For example, if the elevator car 18 is only half full, the tension in a portion of the drive rope 42 between the second deflector sheave 49 and the elevator car 18 may be zero, thereby making the elevator car unresponsive if the drive motor 38 should be signaled to move the elevator car downwardly. To remedy this potential problem, the weight 56 pulls downwardly on the second deflector sheave 49 in order to always maintain in a taut condition a portion of the drive rope 42 between the second deflector sheave 49 and the elevator car 18 even when the elevator car is empty. Thus the weight 56 prevents the elevator system 10 from possibly becoming unresponsive.

Figure 2:
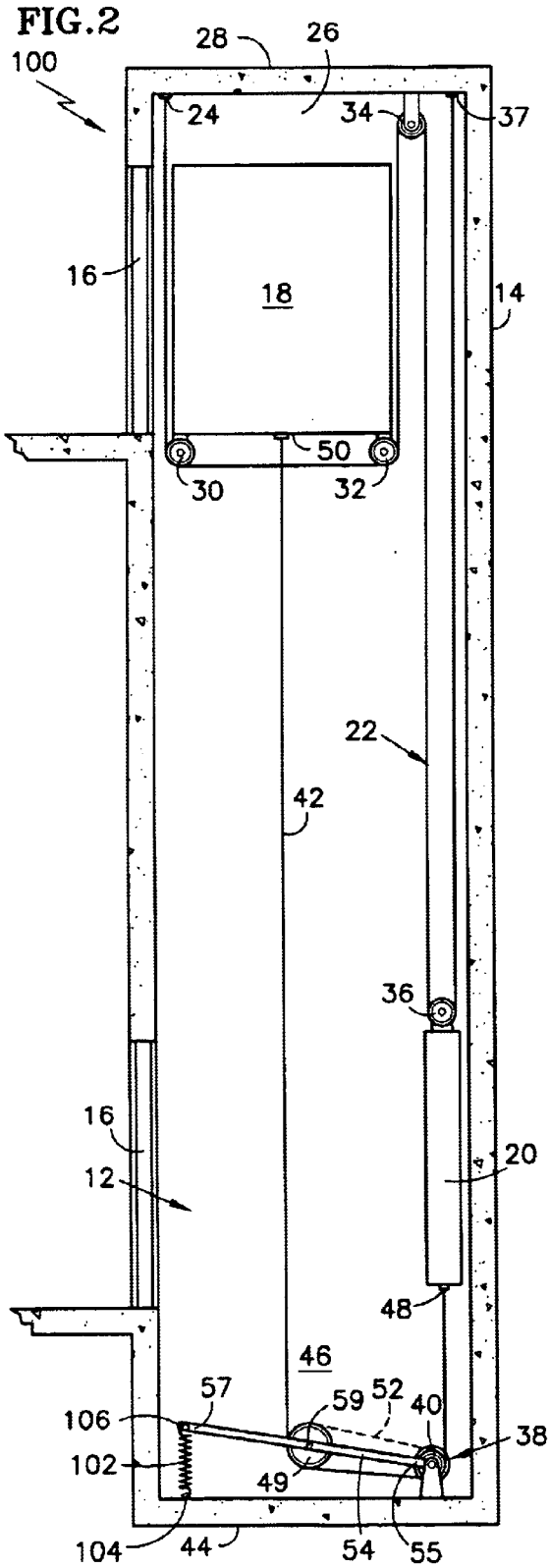
FIG. 2 is a schematic, side elevational view of an elevator system having the drive motor accessibly located in the hoistway pit below the elevator car in accordance with a second embodiment of the present invention.

FIG. 2 illustrates an elevator system 100 which is similar to the elevator system 10 of FIG. 1 except for the implementation of the tension applying mechanism for maintaining the drive rope 42 in a taut condition. Like elements with the embodiment of FIG. 1 are labeled with like reference numbers. As shown in FIG. 2, a tension spring 102 is coupled at a first or lower end 104 within a lower portion of the hoistway 12, such as to the floor 44 or along a sidewall of the hoistway at a lower elevation than that of the second end 57 of the rigid connector 54. The spring 102 is coupled at a second or higher end 106 to the second end 57 of the rigid connector 54 to pull downwardly on, and thereby pivot the rigid connector downwardly about its first end 55. The downwardly pivoting rigid connector 54 in turn moves the second deflector sheave 49 downwardly in order to maintain in a taut condition a portion of the drive rope 42 between the second deflector sheave 49 and the elevator car 18. Thus, the rigid connector 54 and the tension spring 102 cooperate as a tension applying mechanism for maintaining the drive rope 42 in a taut condition.

Figure 3:
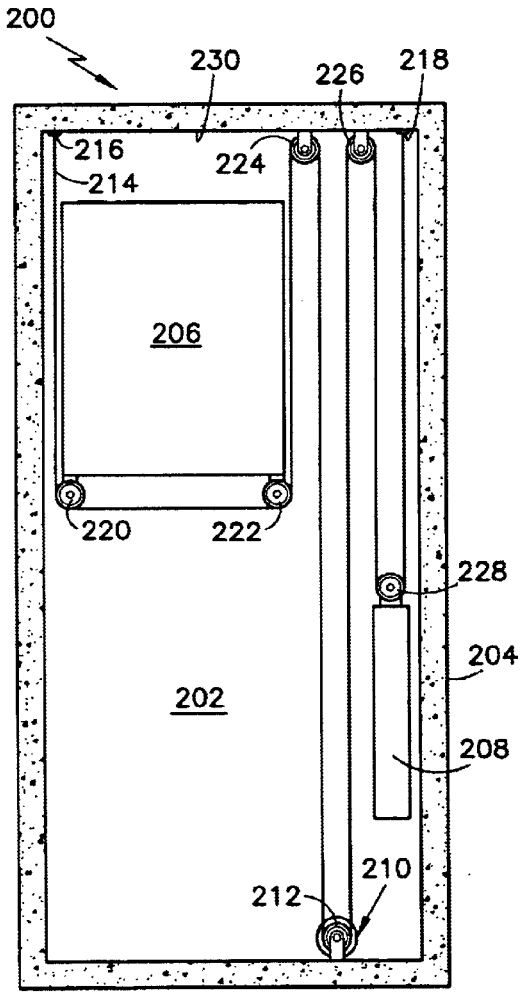
FIG. 3 is a schematic, side elevational view of an elevator system having the drive motor accessibly located in the hoistway pit below the elevator car in accordance with a third embodiment of the present invention.

Turning now to FIG. 3, a further embodiment of the present invention is illustrated by the elevator system 200. The elevator system 200 includes a hoistway 202 defined by the surrounding structure 204 of a building. An elevator car 206 is provided in the hoistway 202 for upward and downward movement along the hoistway via conventional elevator guide rails (not shown). A counterweight 208 movably coupled to conventional counterweight guide rails (not shown) is located at a side of the hoistway 202 in a space extending along the length of the hoistway between the elevator car 206 and the sidewall 204 of the hoistway for balancing the elevator car during its upward and downward movement along the hoistway. A drive motor 210 and associated drive sheave 212 are disposed in a lower portion of the hoistway 202, such as in the hoistway pit.

The elevator system 200 further includes at least one flat rope or belt 214 for providing both suspension and traction for the elevator car 206 and the counterweight 208. The flat rope 214 may be made of steel, non-metallic fiber or any other suitably strong material to support the elevator car 206 and the counterweight 208 during movement and acceleration of the car and counterweight along the hoistway 202. The flat rope 214 is attached at first and second ends 216, 218 within an upper portion of the hoistway 202, such as to a sidewall, guide rails or ceiling of the hoistway. The flat rope 214 extends downwardly from its first end 216, loops generally 90° about a first elevator sheave 220 coupled underneath and at one side of the elevator car 206, extends generally horizontally to a second elevator sheave 222 coupled underneath and at an opposite side of the elevator car, loops generally 90° about the second elevator sheave 222, extends upwardly and loops generally 180° about a first deflector sheave 224 fixed within an upper portion of the hoistway such as to a sidewall or ceiling of the hoistway, extends downwardly and loops generally 180° about the drive sheave 212, extends upwardly and loops generally 180° about a second deflector sheave 226 fixed within an upper portion of the hoistway, extends downwardly and loops generally 180° about a counterweight sheave 228 coupled to a top portion of the counterweight 208, and extends upwardly and is coupled at its second end 218 within an upper portion of the hoistway, such as to the sidewall or ceiling of the hoistway. The underslung elevator car 206 avoids the need to provide a drive motor above the hoistway 202 either between the elevator car 206 and a ceiling 230 of the hoistway, or in a costly and space-consuming machine room. Further, flat rope technology reduces the size of the drive motor and sheaves necessary to support and move a given load compared to conventional round ropes, and thereby reduces the size of and cost for constructing the space within the hoistway pit for accommodating the drive motor and sheaves.

Although this invention has been shown and described with respect to exemplary embodiments thereof, it should be understood by those skilled in the art that the foregoing and various other changes, omissions, and additions in the form and detail thereof may be made therein without departing from the spirit and scope of the invention. Accordingly, the present invention has been described in several embodiments by way of illustration rather than limitation.

What is claimed is:

1. An elevator system comprising:

an elevator hoistway defined by surrounding structure;

an elevator car and counterweight located in the hoistway;

a drive motor including a drive sheave located at a bottom portion of the hoistway, the drive motor being coupled to the elevator car and the counterweight via at least one flat rope for moving the elevator car upwardly and downwardly along the hoistway, wherein the at lease one flat rope includes a suspension rope coupled to the elevator car and the counterweight, and drive rope engaging the drive sheave for moving the elevator car along the suspension rope; and further including at least one elevator sheave coupled to an underside of the elevator car, a deflector sheave coupled within an upper portion of the hoistway, and a counterweight sheave coupled to a top portion of the counterweight, the suspension rope having its first and second ends coupled to an upper portion of the hoistway, the suspension rope extending downwardly from is first end, underslinging the elevator car via the elevator sheave, extending upwardly and looping about the deflector sheave, extending downwardly and looping about the counterweight sheave and extending upwardly and terminating at its second end.

2. An elevator system comprising:

an elevator hoistway defined by surrounding structure;

an elevator car and counterweight located in the hoistway;

a drive motor including a drive sheave located at a bottom portion of the hoistway, the drive motor being coupled to the elevator car and the counterweight via at least one flat rope for moving the elevator car upwardly and downwardly along the hoistway, wherein the at lease one flat rope includes a suspension rope coupled to the elevator car and the counterweight, and drive rope engaging the drive sheave for moving the elevator car along the suspension rope;

a deflector sheave located at a lower portion of the hoistway, and wherein the drive rope has first and second ends, the drive rope having its first end coupled to a bottom portion of the counterweight and its second end coupled to a bottom portion of the elevator car, the drive rope extending downwardly from its first end, looping about the drive sheave, extending toward and looping about the deflector sheave and extending upwardly and terminating at its second end at the bottom portion of the elevator car; and a tension applying mechanism for imparting a downward force on the deflector sheave in order to maintain the drive rope in a taut condition, wherein the tension applying mechanism includes a weight suspended from a tension spring, and a rigid connector pivotally coupled at a first end to the drive sheave, coupled at a second end to the weight and coupled between its first and second ends to the deflector sheave, whereby the weight imparts a downward force on the deflector sheave in order to maintain the drive rope in a taught condition.

3. An elevator system comprising:

an elevator hoistway;

an elevator car located in the hoistway;

a drive motor located at a bottom portion of the hoistway, the drive motor being coupled to the elevator car via at least one flat rope for moving the elevator car along the hoistway, wherein the at least one flat rope includes a suspension rope could to the elevator car and a drive rope engaging the drive motor for moving the elevator car;

a deflector sheave located at a lower portion of the hoistway, wherein the drive rope is engaged with the elevator car, the drive rope extending downwardly from the car, looping about the drive sheave, extending toward and looping about the deflector sheave; and a tension applying mechanism for imparting a downward force on the deflector sheave in order to maintain the drive rope in a taut condition, wherein the tension applying mechanism includes a weight suspended from a tension spring, and a rigid connector pivotally coupled at a first end to the drive sheave, coupled at a second end to the weight and coupled between its first and second ends to the deflector sheave, whereby the weight imparts a downward force on the deflector sheave in order to maintain the drive rope in a taught condition.

* * * * *